US012188185B2

(12) United States Patent
Holloway

(10) Patent No.: US 12,188,185 B2
(45) Date of Patent: Jan. 7, 2025

(54) METHOD, APPARATUS AND SYSTEM FOR LIFTING RAILROAD STRUCTURES

(71) Applicant: ENERPAC TOOL GROUP CORP., Menomonee Falls, WI (US)

(72) Inventor: Eric Holloway, Boise, ID (US)

(73) Assignee: ENERPAC TOOL GROUP CORP., Menomonee Falls, IL (US)

( * ) Notice: Subject to any disclaimer, the term of this patent is extended or adjusted under 35 U.S.C. 154(b) by 89 days.

(21) Appl. No.: 17/616,290

(22) PCT Filed: Dec. 1, 2021

(86) PCT No.: PCT/US2021/061433

§ 371 (c)(1),
(2) Date: Dec. 3, 2021

(87) PCT Pub. No.: WO2022/119939

PCT Pub. Date: Jun. 9, 2022

(65) Prior Publication Data

US 2023/0332359 A1 Oct. 19, 2023

Related U.S. Application Data

(60) Provisional application No. 63/114,901, filed on Nov. 17, 2020.

(51) Int. Cl.
*E01B 29/04* (2006.01)
*E01B 3/20* (2006.01)
(Continued)

(52) U.S. Cl.
CPC ..... *E01B 29/04* (2013.01); *E01B 3/20* (2013.01); *E01B 23/12* (2013.01); *E01B 29/09* (2013.01);
(Continued)

(58) Field of Classification Search
CPC . E01B 29/04; E01B 29/09; E01B 3/20; E01B 27/02; E01B 27/105; E01B 27/17; E01B 2203/10; E01B 23/12
(Continued)

(56) References Cited

U.S. PATENT DOCUMENTS 1,324,698 A * 12/1919 Shovestul ..... E01B 3/26 238/76
1,357,180 A * 10/1920 Nelson ..... E01B 3/18 238/281
(Continued)

FOREIGN PATENT DOCUMENTS

AU 2018222981 A1 * 3/2019 ..... F15B 15/1447
DE 4101432 A1 7/1992
(Continued)

OTHER PUBLICATIONS

Extended European Search Report for European Patent Application No. 21901397.6, dated Jul. 15, 2024.

*Primary Examiner* — Zachary L Kuhfuss
*Assistant Examiner* — James William Jones
(74) *Attorney, Agent, or Firm* — Andrus Intellectual Property Law, LLP

(57) ABSTRACT

A jacking tie and method of using a jacking tie to level and/or lift a railroad track. The jacking tie is configured with an elongate body that is configured to span beneath two parallel rails of a railroad track. Preferably the jacking tie is of the configuration to replace a standard railroad tie. The jacking tie has two jacks, preferably hydraulic cylinder jacks that are positioned so as to lift each of the parallel rails of the railroads. The jacking tie body has two sections. A track support shell is supported by the hydraulic cylinder jacks. The track support shell is configured for nesting or mating engagement with the lower body shell in a compressed or resting position. The hydraulic jack cylinders are configured
(Continued)

to lift the track support shell away from the lower body shell, thus lifting the rail positioned above the hydraulic jack cylinder. The track support shell and lower body shell are pivotally connected such that the ends of the track support shell can be independently raised. Preferably, the pivotal connection is maintained in a slot allowing the pivotal connection to rise and lower when both hydraulic lift cylinders are raised or lowered. This functionality allows for the lifting and lowering of two parallel rails of a railroad track by allowing for the lifting of the track and replacement of ballast beneath the track. Preferably the jacking tie is constructed such that it can be left under the track or alternatively can be extended and left in place while the railroad is maintained in operation or alternatively while a ballast tamper travels along the track.

13 Claims, 13 Drawing Sheets

(51) Int. Cl.

| | |
|---|---|
| ***E01B 23/12*** | (2006.01) |
| ***E01B 29/09*** | (2006.01) |
| *E01B 27/02* | (2006.01) |
| *E01B 27/10* | (2006.01) |
| *E01B 27/17* | (2006.01) |

(52) U.S. Cl.
CPC ..... *E01B 27/02* (2013.01); *E01B 27/105* (2013.01); *E01B 27/17* (2013.01); *E01B 2203/10* (2013.01)

(58) Field of Classification Search
USPC ..... 104/7.1, 7.3, 29–108; 283/72–76, 120
See application file for complete search history.

(56) References Cited

U.S. PATENT DOCUMENTS

| | | | | | |
|---|---|---|---|---|---|
| 1,384,531 | A * | 7/1921 | Kruse | E01B 3/18 | 238/106 |
| 2,157,214 | A * | 5/1939 | Okuda | E01B 29/04 | 254/1 |
| 2,712,433 | A * | 7/1955 | Holt | E01B 29/14 | 254/121 |
| 3,230,895 | A * | 1/1966 | Stewart | E01B 29/04 | 173/2 |
| 3,780,664 | A | 12/1973 | Holley | | |
| 2008/0290627 | A1 * | 11/2008 | Gilbert | B60R 9/06 | 280/204 |
| 2021/0317615 | A1 * | 10/2021 | Holloway | E01B 27/18 | |

FOREIGN PATENT DOCUMENTS

| | | | |
|---|---|---|---|
| KR | 100749800 | B1 * | 8/2007 |
| KR | 20170002828 | A | 1/2017 |
| NL | 2015782 | B1 | 5/2017 |

* cited by examiner

METHOD, APPARATUS AND SYSTEM FOR LIFTING RAILROAD STRUCTURES

PRIORITY/CROSS-REFERENCE TO RELATED APPLICATIONS

This application claims the benefit of U.S. Provisional Application No. 63/114,901, filed Nov. 17, 2020 and International Application No. PCT/US21/61433 filed Dec. 1, 2021, the disclosure of which is incorporated by reference.

TECHNICAL FIELD

The disclosure generally relates to the field of railroad maintenance. Particular embodiments relate to a method, apparatus and system for lifting railroad structures, namely lifting sunken railroad structures and providing support to railroad structures.

BACKGROUND INFORMATION

Railroad tracks are typically comprised of two spaced apart parallel tracks that are configured for the rail wheel of a railroad vehicle, such as a train. The rails are connected to ties, also called sleepers, that span in a generally perpendicular orientation between the rails. Each tie is typically connected to each rail by a tie plate connected to the rail and connected to the tie by several fasteners, typically called spikes. The ties and rails are positioned on a bed of a ballast of crushed rock overlaying a base. The ballast is typically comprised of a crushed rock, such as granite.

The location where two or more railroad tracks intersect or merge is referred to herein as a structure. Railroad structures including diamonds, frogs, switches and other railroad structures used to facilitate the crossing, merging, and separation of two or more railroad tracks. The intersection of multiple tracks in a location leads to increased use of that location as trains on each multiple trains from multiple directions. This increases the weight that is placed upon each structure in comparison to a single set of tracks. This increased use typically causes the structures to sink relative to the single tracks leading to the structure as the ballast beneath the structure is compacted or worn. The sinkage rate varies, but structures often need to be lifted as often as three to four times per year.

Typical methodology used to raise a structure and to return to level or nearly level with surrounding track is to utilize a crane and to lift the track and then to replenish the ballast manually beneath the track. This ballast replacement method does not allow for typical ballast filling vehicles, that travel on the railroad track and use arms to fill ballast on the track beneath it, and instead requires manual labor with limited machine assistance. While this process returns the structure to an acceptable height, it can be difficult to obtain a true level with the track leading into and out of the structure and requires a significant amount of time and labor to achieve. Further, railroad structures that have substantial traffic typically must have the ballast replaced more often than low traffic areas. What is needed is a method, apparatus, and/or system that can be utilized to reduce the amount of time and manual labor required to level a structure or to bring it to a crowned position to allow for additional time between leveling. What is further needed is a lifting option for raising a structure, or alternatively a section of railroad track, that can remain in place to facilitate future maintenance including lifting of the structure and/or track and replacing the ballast as necessary.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a method, apparatus, and system for returning a railroad rail and if the rail is associated with a structure, to extend that railroad structure to level, or even with an upward crown to extend the duration of time each structure can operate before needing to be leveled again. In a preferred embodiment the method involves the step of removing a series of ties beneath a railroad track adjacent to or at a structure. The tie removal involves removing the fastener attaching each rail to the tie and sliding or pulling the tie from beneath the rail. A jacking tie is then positioned in the void beneath the adjacent rails. Multiple jacking ties can be utilized by repeated this step sufficiently around the structure such that the jacking ties can be utilized together to lift the entirety of the structure. The jacking ties each have hydraulic jacks at opposing ends of the jacking ties. The jacking tie is constructed with an upper portion attached to a lower portion by a pivot connector. The pivot connector allows the first end and second end of the upper portion of the jacking tie to move up and down relative to the lower portion. Two jacks are positioned on opposing sides of the pivoting connector. Preferably the jacks are hydraulic cylinder jacks, although within the scope of the invention any type of jack can be utilized. The pivot connector is attached to the lower section at a slot that allows the pivot connector to slide up and down as the upper portion is lifted and lowered by the lifts, typically a hydraulic jack. Alternatively the slot can be configured in the track support shell. Alternatively the jacking tie can be pneumatic, electrical or mechanical.

In a preferred embodiment, the hydraulic jacks are preferably connected to the hydraulic pump at a manifold. The manifold preferably has independently operated valves for each jack. In a preferred embodiment two jacking ties are utilized to move a structure, although fewer or additional jacking ties can be utilized. In a preferred embodiment the hydraulic jacks are labeled with an indicator, such as a flag, tag, or color applied to the jack, that corresponds with a color at the manifold such that a user can actuate the correct valve for the correct jack. Preferably each hydraulic jack is positioned within the jacking tie proximate to an end of the jacking tie.

After the jacking tie is positioned beneath the rail proximate to or at the structure, the hydraulic jacks are selectively actuated to lift and/or level the structure to preferably at or above its original height to either level the structure or provide a crown to the structure. A railroad level is typically placed across the structure. The railroad level is a standard tool in the railroad industry and typically measures track gauge and superelevation. Typically the structure is lifted and leveled by selectively actuating each jack, checking for level, and raising and lowering each jack until the desired level is achieved.

After the structure is lifted to its desired elevation, the operator preferably disconnects each jack from the hydraulic pump. The ends of the hydraulic lines connected to each jack can then be connected together to prevent debris from entering the fittings on the lines and prevent damage to the fittings and line. The hydraulic jacks utilized preferably have counter balance valves and thus remain lifting the structure.

A tamper machine traveling on the track is then brought across the rail to the structure that has been lifted. The tamper machine squeezes and tamps ballast under the existing elevated ties while not placing ballast into the void created by the removed tie. The level of the structure is then checked again.

In a preferred embodiment the hydraulic jacks are then hydraulically connected to the hydraulic pump. If the structure is not level, the jacking tie can again be utilized to lift the structure, followed by tamping of ballast by the tamping machine. Once suitable level is achieved, if removal of the jacking tie is desired, the hydraulic jacks are depressed and removed, the tie that has been removed is replaced, and the tamping machine installs ballast beneath and/or around the replaced tie. Alternatively the jacking tie can remain positioned under the rail for future raising and/or leveling use. Preferably the jacking tie has a bypass valve such that jacking ties in transport cannot be hydraulically activated while in storage and/or transport.

In the preferred embodiment a hydraulic pump is provided that is housed on a frame and configured for selective actuation of the hydraulic jacks. An exemplary system is disclosed in U.S. patent application Ser. No. 17/229,810 (PCT Application No. PCT/US21/21170). The frame is configured to be movable, preferably by a forklift and/or hoist or crane. The frame is configured with a manifold hydraulically connected to the hydraulic pump. The manifold is configured to selectively actuating hydraulic jacks that are in hydraulic connection with the manifold. The manifold has an outflow port and an inflow port for each connection for each jack and an independent valve for each hydraulic outflow to allow for selective actuation of each hydraulic jack. Each valve can be manually operated or electronically operated, including remote operation. In a preferred embodiment the hydraulic pump and manifold system disposed of in U.S. provisional patent No. 63/009,351, the contents of which are hereby incorporated by reference.

Preferably the frame for holding the hydraulic pump has a jack mounting plate configured for mounting the hydraulic jacks for facilitating transport of the system. The frame can further be configured for mounting of additional spare hydraulic lines. The frame preferably is configured with a hydraulic hose reel for storage of hydraulic line used for hydraulically connecting the hydraulic jacks to the hydraulic pump.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE FIGURES

Figure 1:
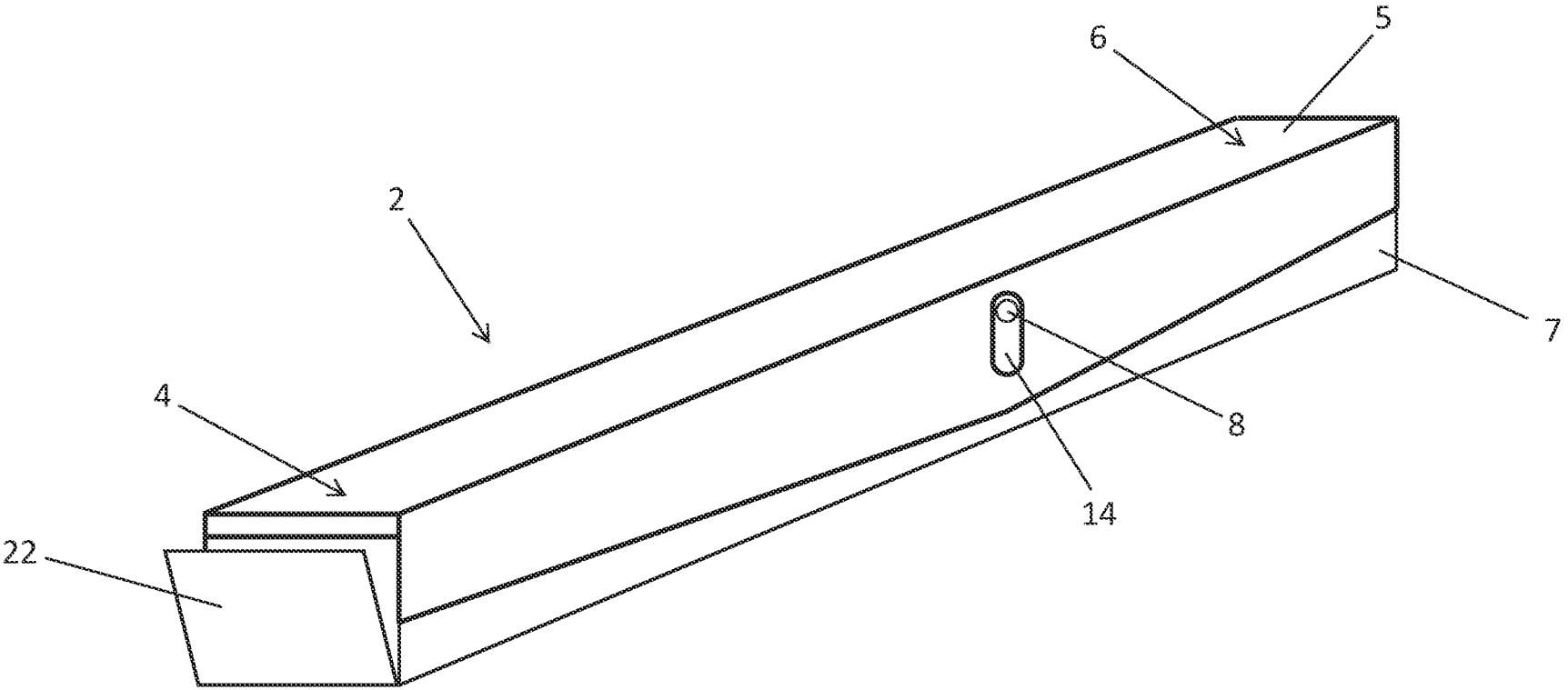
FIG. 1 is a perspective view of a preferred embodiment of a jacking tie having both cylinders closed or not extended.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Figure 2:
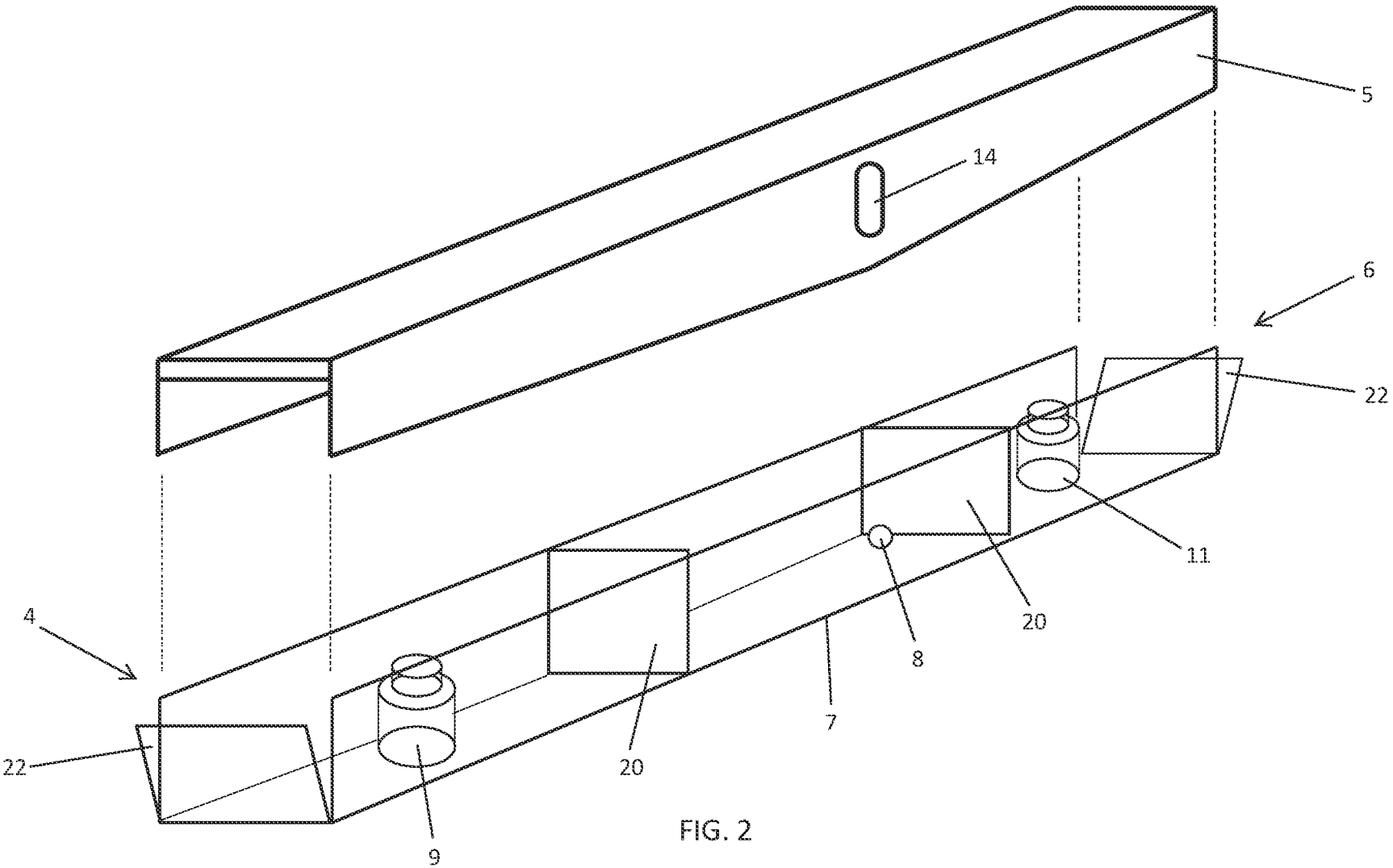
FIG. 2 is a partially exploded view of a preferred embodiment of a jacking tie.

FIG. 1 illustrates a preferred embodiment of a jacking tie 2 in a closed or resting position. The jacking tie has an elongate body that is formed of an upper section 5 (also called a track support shell) and a lower section 7 (also called a lower body shell). The opposing sections or shells house a first hydraulic jack cylinder (shown as 9 in FIG. 2) positioned at or near the first end 4 of the jacking tie and a second hydraulic jack cylinder (shown as 11 in FIG. 2) positioned at the second end of the jacking tie 6, as shown in FIG. 2. While the depicted preferred embodiment utilizes hydraulic jack cylinders, alternate jacks can be utilized such as pneumatic, electrical, or mechanical. The first hydraulic jack cylinder is configured to lift the track support shell at the first end of the jacking tie while the second hydraulic jack cylinder is configured to lift the track support shell at the second end. Each hydraulic cylinder is positioned within the jacking tie.

The jacking tie 2 is configured to be positioned such that it spans beneath adjacent railroad rails of a railroad structure. The jacking tie can be utilized to lift a railroad structure or alternatively an independent section of railroad rail. The track support shell 5 of the jacking tie and the lower body shell of the jacking tie 7 are connected in the depicted embodiment via a pivot pin 8 positioned at or near a longitudinal center of the jacking tie. The pivot pin allows for the pivoting of the track support shell 5 relative to the lower body shell 7. This pivoting action allows each end of the track support shell to be adjusted independently to level the track or alternatively to raise the track by actuating the hydraulic jack cylinders simultaneously or sequentially. Hydraulic lines can be supplied to the jacks through the end doors (or plates) or alternatively through connections through the wall of the body of the jacking tie. Preferably either the track support shell or lower body shell utilizes a slot 14 that allows for vertical travel of the pivot pin. The vertical slot allows for vertical adjustment of the track support shell relative to the lower body shell, while allowing for pivotal adjustment of the track support shell on the pivot pin.

FIGS. 1-8 illustrate an embodiment of the invention having an end plate door to prohibit access to the hydraulic jack cylinders. Preferably the end plate door is lockingly attached to the end of the railroad jacking tie.

In preferred operation, a railroad tie is removed from beneath a railroad. The jacking tie is positioned spanning between the two adjacent rails. A hydraulic pump (not shown) is connected and independent circuits through each of the hydraulic lifts. Each lift is then actuated to raise the jacking tie and railroad rail positioned on the tie upward or lowered. In this manner the railroad rail and or structure can be lifted and/or leveled.

In a preferred embodiment the jacking tie is configured to be locked in a lifted position. The hydraulic lines can be disconnected from each of the hydraulic lifts. Preferably the hydraulic line is connected to each hydraulic lift by a quick connect. In a preferred embodiment the quick connect and hydraulic lift are positioned within the railroad tie structure and accessed via the end cavities 22 at each end of the railroad jacking tie. In a preferred embodiment a bypass valve is provided between the two disconnects for storing the jacking tie in a stored position. The purpose of the bypass valve is to prevent the hydraulic system from pressurizing when the railroad jacking tie is not in use.

FIG. 2 illustrates a partially exploded view of a jacking tie. The track support shell has been removed from the lower body shell, with the walls of the lower track shell shown transparently to illustrate internal structural baffles 20 and hydraulic jack cylinders 9, 11.

Figure 3:
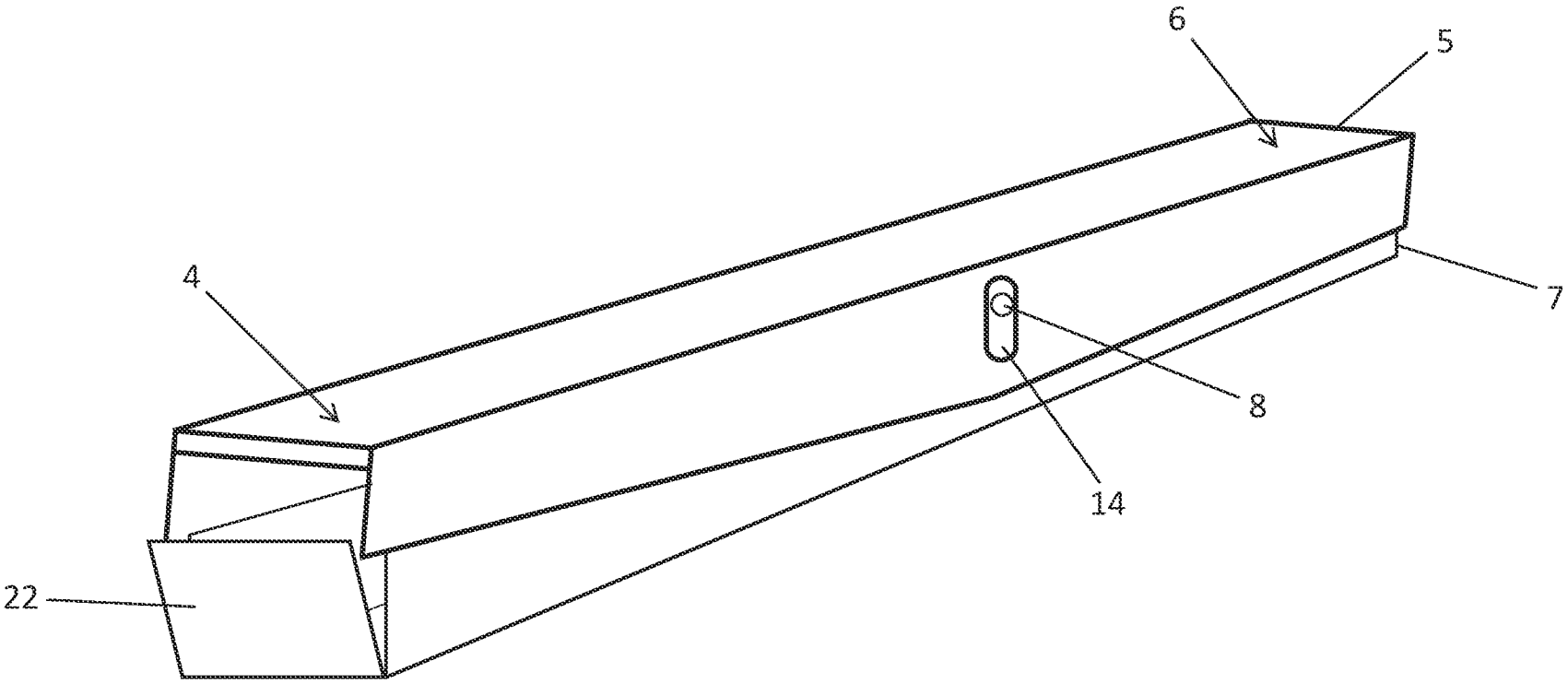
FIG. 3 is a perspective view of a preferred embodiment of a jacking tie having one hydraulic cylinder extended more than the other hydraulic cylinder.

FIG. 3 illustrates the railroad jacking tie having the first end 4 of the track support shell in a lifted position with the first hydraulic jack cylinder extended. Each of the ends of the jacking tie can be independently actuated by the independently operating the hydraulic jack cylinder positioned associated with the end of the body of the jacking tie. The channel is configured to slide vertically to allow the track support shell to move vertically will remaining in pivotal connection with the lower body shell. Alternatively the channel can be configured in the lower member with the pivot pin configured to slide vertically in the channel. In this manner the track support shell is allowed to lift on each end and pivot to allow each of the opposing ends 4, 6, to be lifted and lowered independently.

Figure 4:
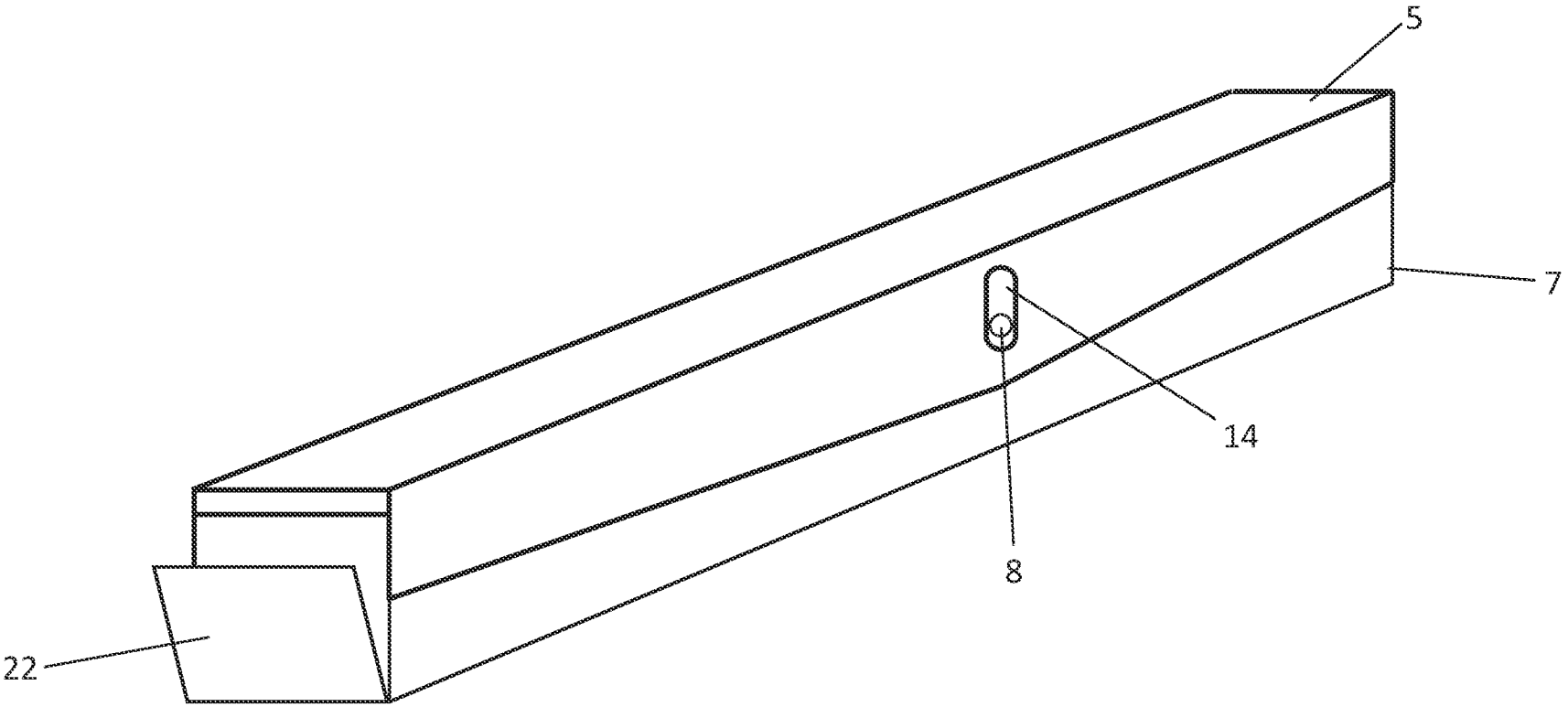
FIG. 4 is a perspective view of a preferred embodiment of a jacking tie having both hydraulic cylinders extended.

FIG. 4 illustrates the railroad jacking tie in which both ends 4, 6 have been lifted a similar vertical distance.

Figure 5:
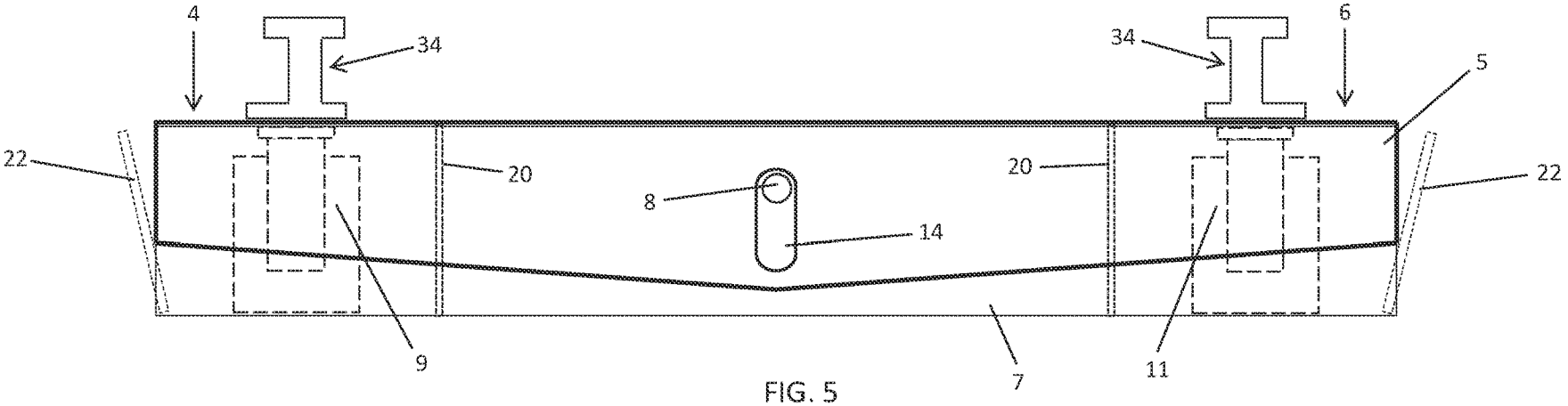
FIG. 5 is an isometric view of a preferred embodiment of a jacking tie in a closed or compressed position.
Figure 6:
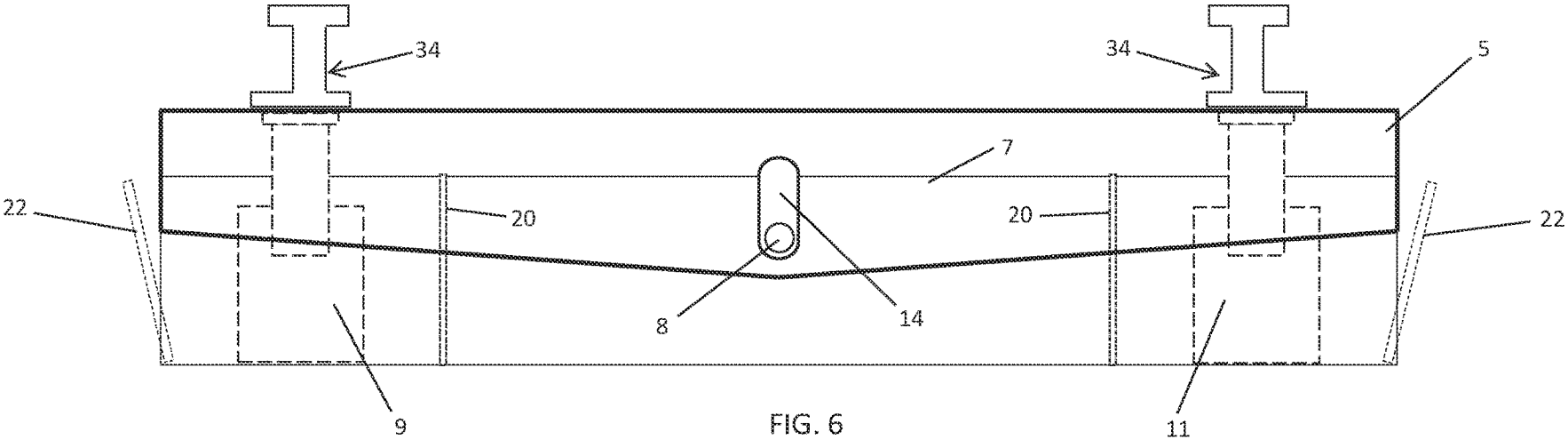
FIG. 6 is an isometric view of a preferred embodiment of a jacking tie in an extended position having both hydraulic cylinders extended.

FIG. 5 illustrates a jacking tie in a closed or lowered position. The internal components of the jacking tie, specifically hydraulic jack cylinders 9, 11 and structural baffles 20 are shown in broken lines to illustrate internal components. The rails 34 of the railroad track are shown positioned on the track support shell positioned above the hydraulic cylinders 9, 11. The track support shell is in a lowered position with slot 14 positioned with the pivot pin at the upper end of the slot. FIG. 6 illustrates the jacking tie in an extended position with both hydraulic cylinders extended, lifting the track support shell and rails thereon upward. The track pivot pin 8 is positioned at the lower end of the slot 14, illustrating the track support shell is at or near its uppermost travel limitation.

Figure 7:
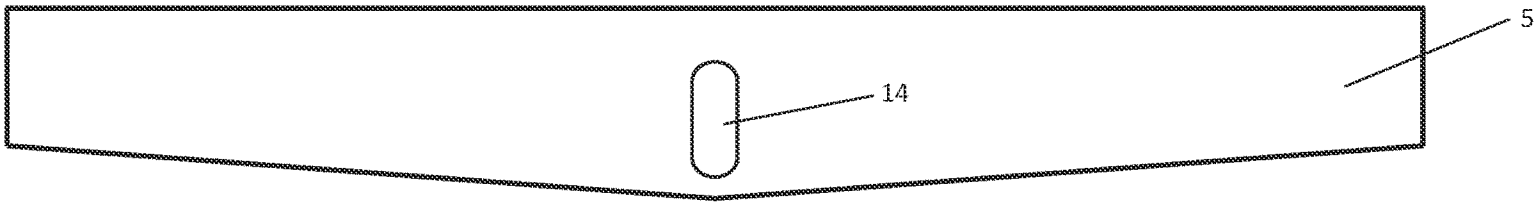
FIG. 7 is an isometric view of an upper shell of a preferred embodiment of a jacking tie.
Figure 8:
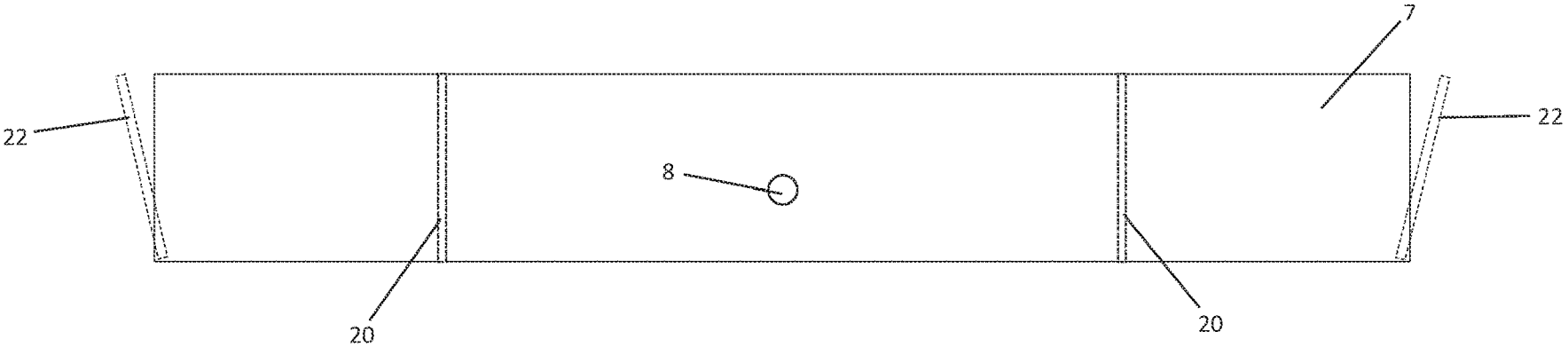
FIG. 8 is an isometric view of a lower shell of a preferred embodiment of a jacking tie.

FIG. 7 illustrates an isometric view of the upper shell of a jacking tie. FIG. 8 illustrates an isometric view of the lower shell of a jacking tie.

Figure 9:
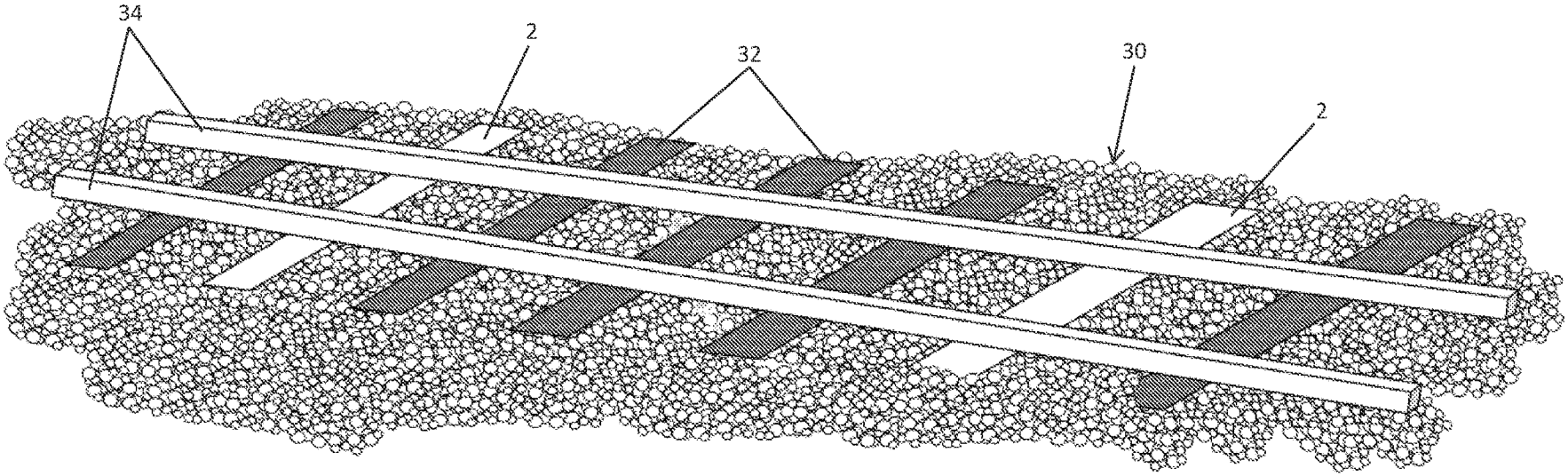
FIG. 9 is a perspective view of a railroad track having rails and ties including two preferred embodiments of jacking ties substituted for traditional railroad ties.

FIGS. 9-18 illustrate various uses and methodology for utilizing one or more jacking ties. FIG. 9 illustrates a railroad track in which two jacking ties 2 are installed. The jacking ties have been substituted for preexisting railroad ties. The preexisting railroad ties 32 are shown between the installed jacking ties. The orientation of the standard railroad track is shown as having two parallel rails 34 extending across railroad ties that are generally perpendicular to the rails. The jacking ties would then be utilized to lift the rails 34. This will also lift the railroad ties that are positioned near each jacking tie. This allows for the whole of the railroad track to be lifted and leveled.

Figure 10:
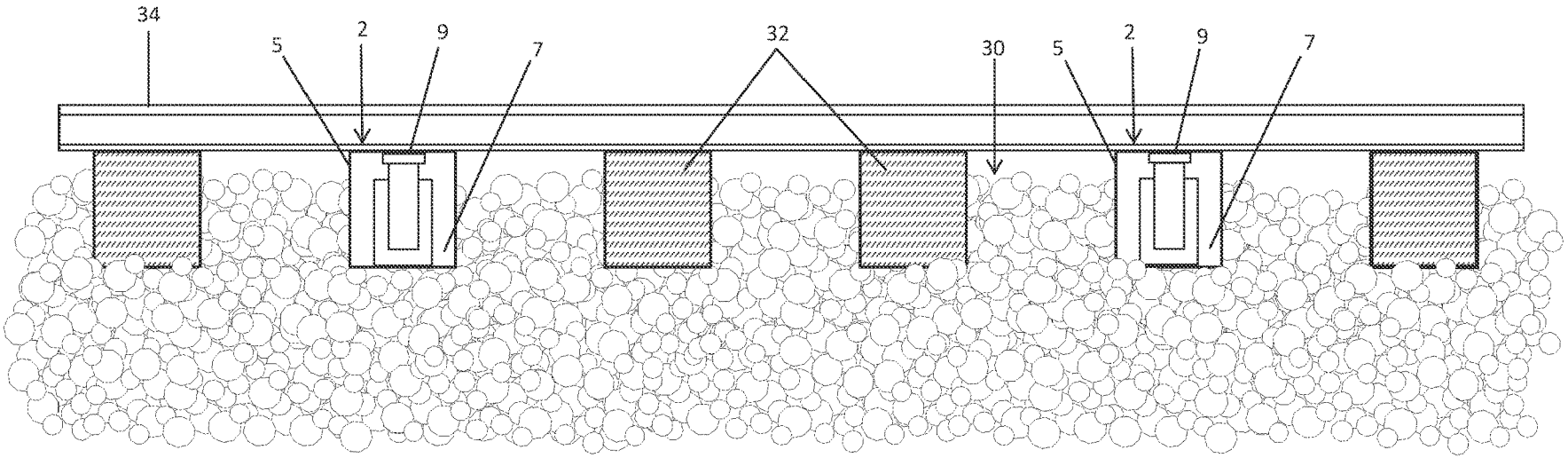
FIG. 10 is an isometric side view of a railroad track having two preferred embodiments of jacking ties installed in a resting or non-extended position.

FIG. 10 illustrates the positioning of two jacking ties 2. The jacking ties are shown with the track support shell 5 and lower body shell 7. A hydraulic cylinder 9 is shown in each jacking tie. The hydraulic cylinder is configured to lift the track support shell away from the lower body shell effectively lifting the railroad rail 34 and associated remaining ties 32. This allows for ballast to be positioned in the voids beneath and around the lifted ties. The jacking ties can then be removed and ballast positioned in the voids remaining from removal of the jacking ties. Alternatively, the jacking ties can be left beneath the railroad line for future use. The jacking ties can be constructed to lock the hydraulic jacks in an extended position.

Figure 11:
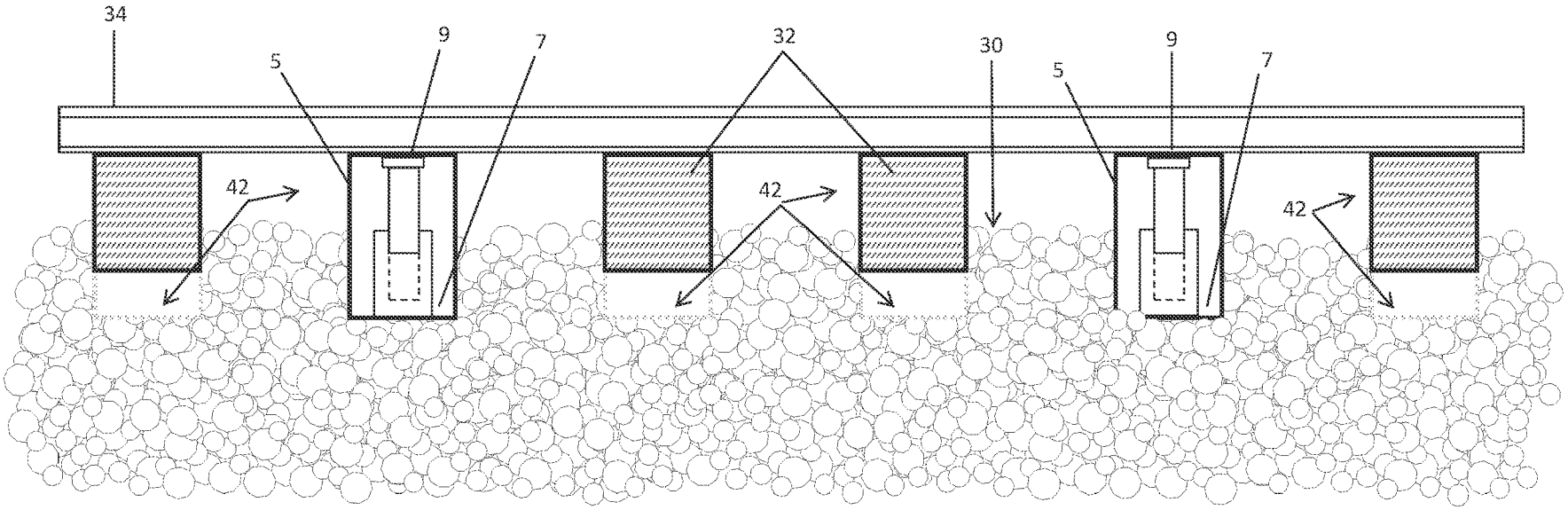
FIG. 11 is the railroad track of FIG. 10 having the two preferred embodiments of jacking ties extended, raising the track.

FIG. 11 illustrates the lifted railroad track and rails 34 of FIG. 10. The hydraulic jacks are shown in an extended position creating voids 42 in and around the preexisting railroad ties 32. The voids are in and around the ballast 32 that supports the railroad ties and track. The illustrated voids can then be filled with additional ballast or alternatively ballast can be repositioned from other areas.

Figure 12:
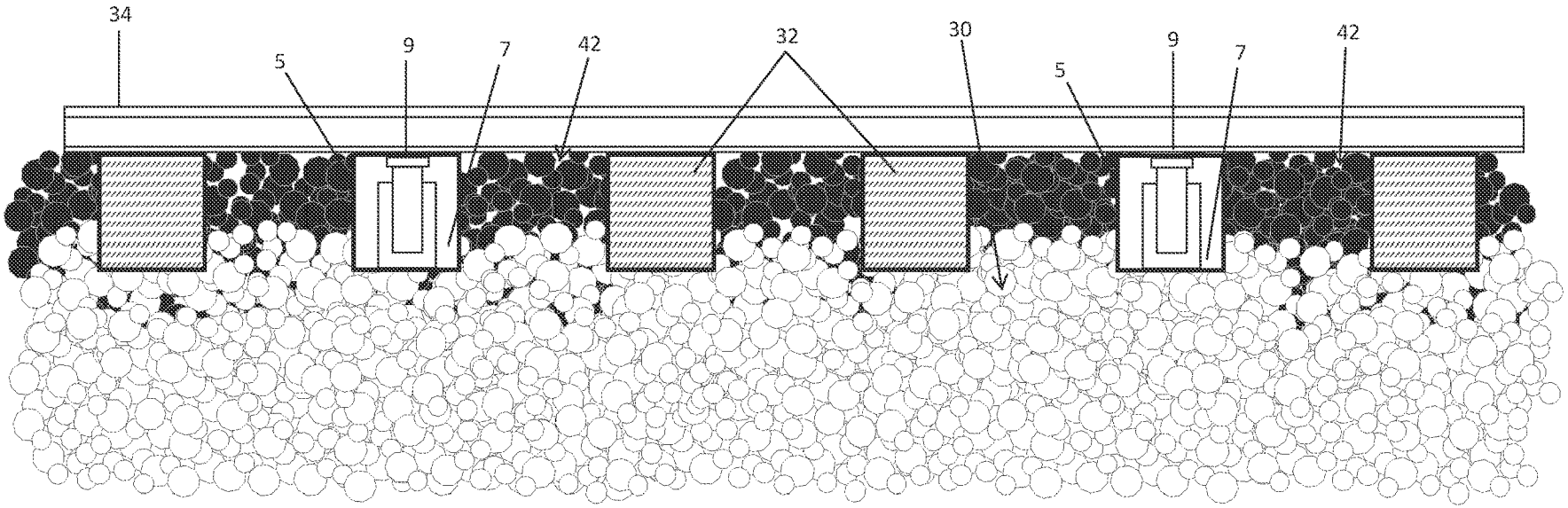
FIG. 12 is the railroad track of FIG. 11 having ballast filling in the gaps of FIG. 11

FIG. 12 illustrates that after the ballast has been replaced in the voids, the jacking ties can be compressed. This allows for ballast to be positioned in and around the voids created by compression of the jacking ties. New ballast 42 is shown as shaded. The illustrated rails 34 and associated track has now been leveled and/or lifted.

Figure 14:
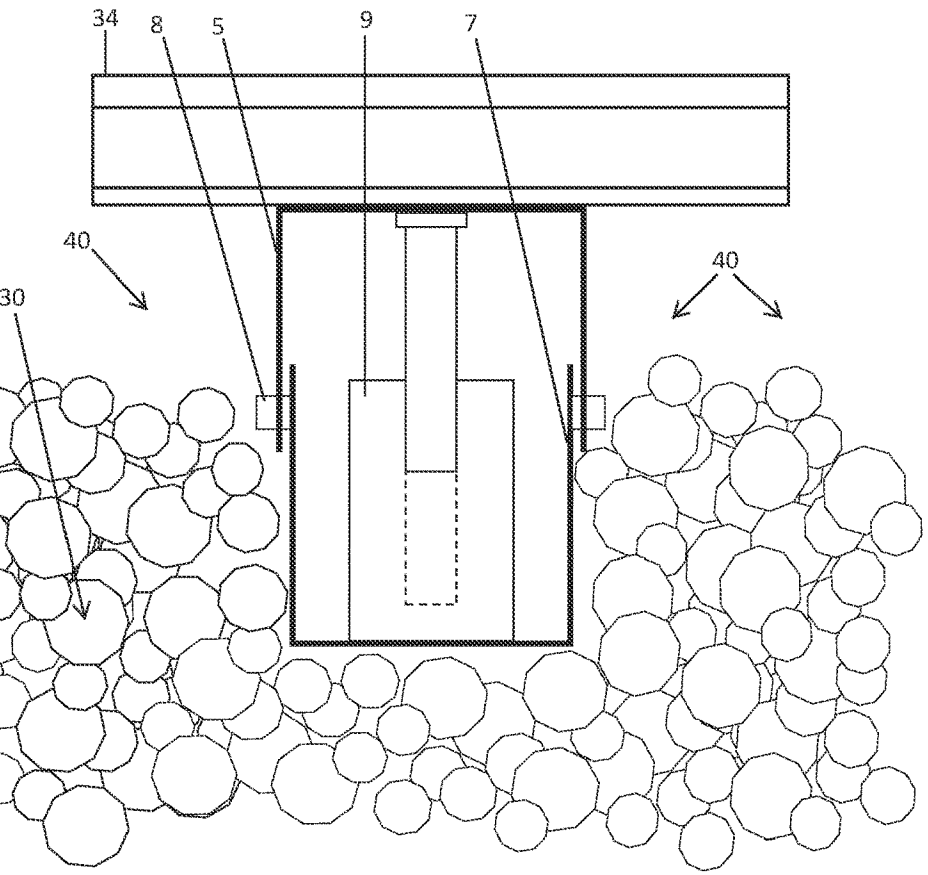
FIG. 14 illustrates the side view of FIG. 12 with a preferred embodiment of a hydraulic jack extended raising the track.
Figure 13:
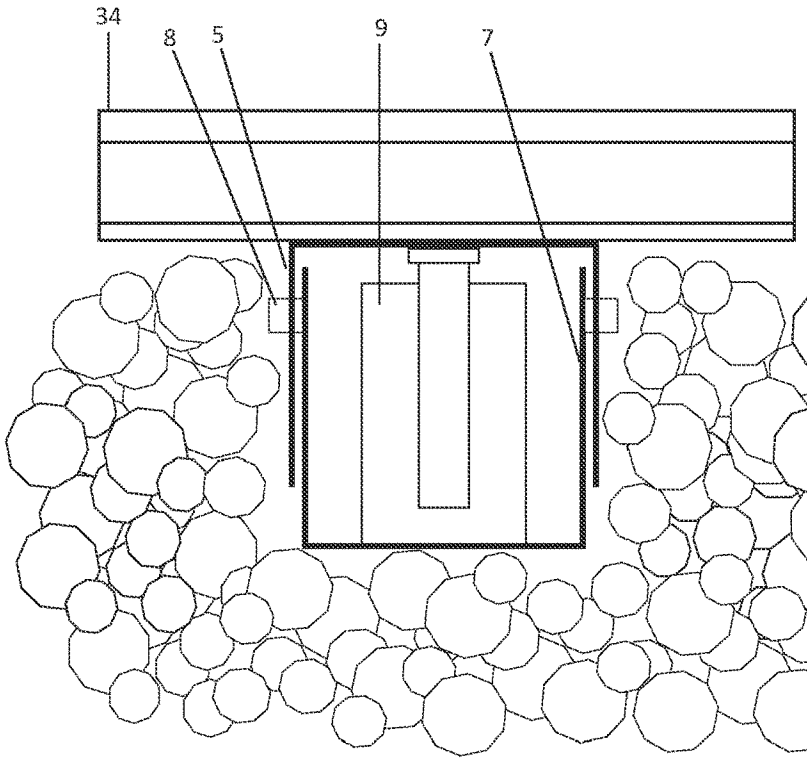
FIG. 13 illustrates a side view of a preferred embodiment of a jacking tie in a resting or closed position.

FIGS. 13 and 14 illustrate a magnified view of the operation of the jacking tie. FIG. 13 illustrates placement of the jacking tie beneath the rail 34. The ballast beneath the rail has been excavated allowing for a void (not shown) into which the jacking tie has been positioned. The jacking tie is typically constructed to be slid into the void created by excavating or removal of the preexisting railroad tie. FIG. 14 illustrates the jacking tie having a hydraulic cylinder 9 in the extended position. In the extended position, the track support shell 5 has been extended away from the lower body shell 7. A void 40 has been created allowing for placement of additional ballast to support the railroad line.

Figure 16:
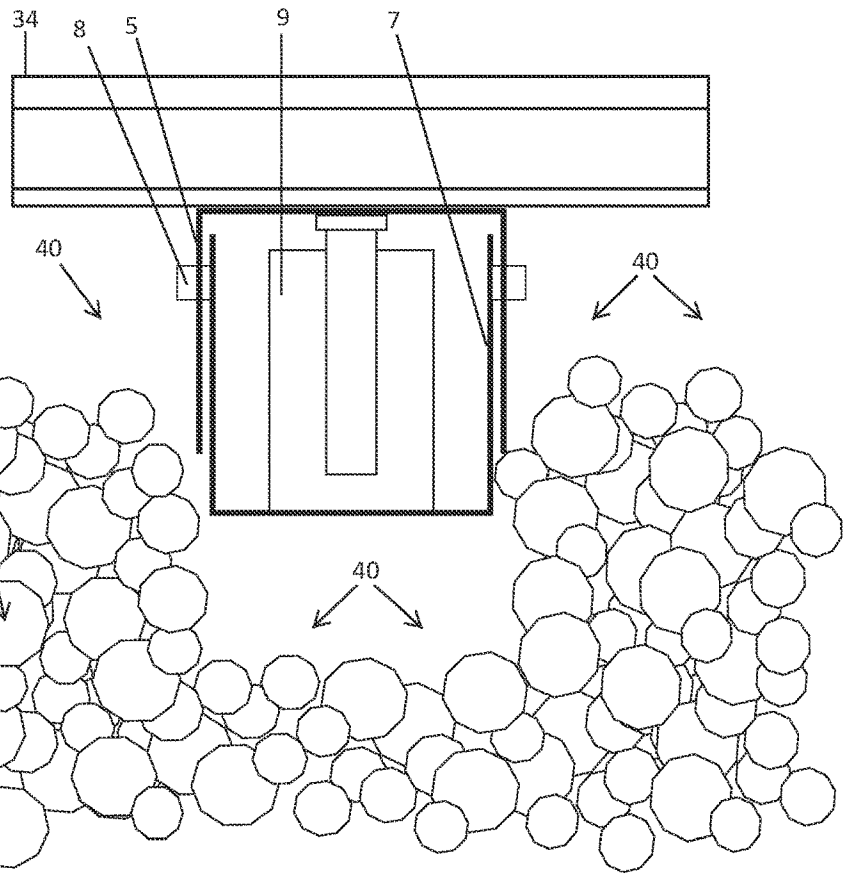
FIG. 16 illustrates the side view of FIG. 15 with the preferred embodiment of a jacking tie resting or compressed, creating voids for ballast to fill.
Figure 15:
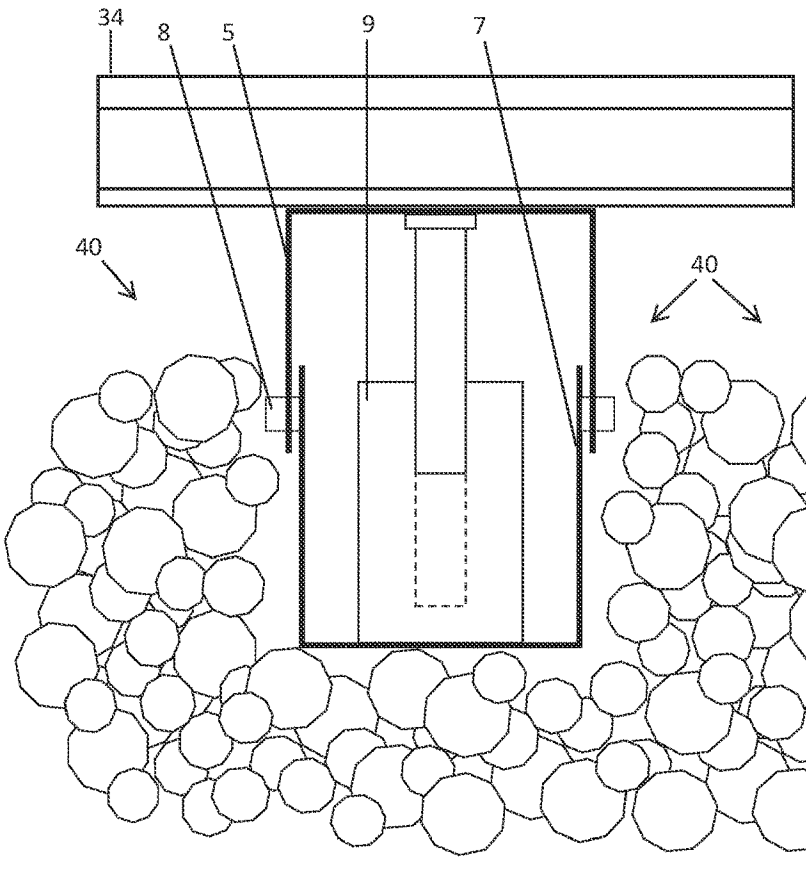
FIG. 15 illustrates a preferred embodiment of a jacking tie raising a track.

FIGS. 15 and 16 illustrate a jacking tie having a hydraulic jack cylinder 9 in an extended position in FIG. 15. Ballast can then be positioned in and around the jacking tie. Alternatively, as ballast is positioned nearby the jacking tie, the cylinder can be compressed or deactivated as shown in FIG. 16. The jacking tie is suspended due to its connection to the now supported rail 34. Ballast can then be positioned into the voids 40.

Figure 18:
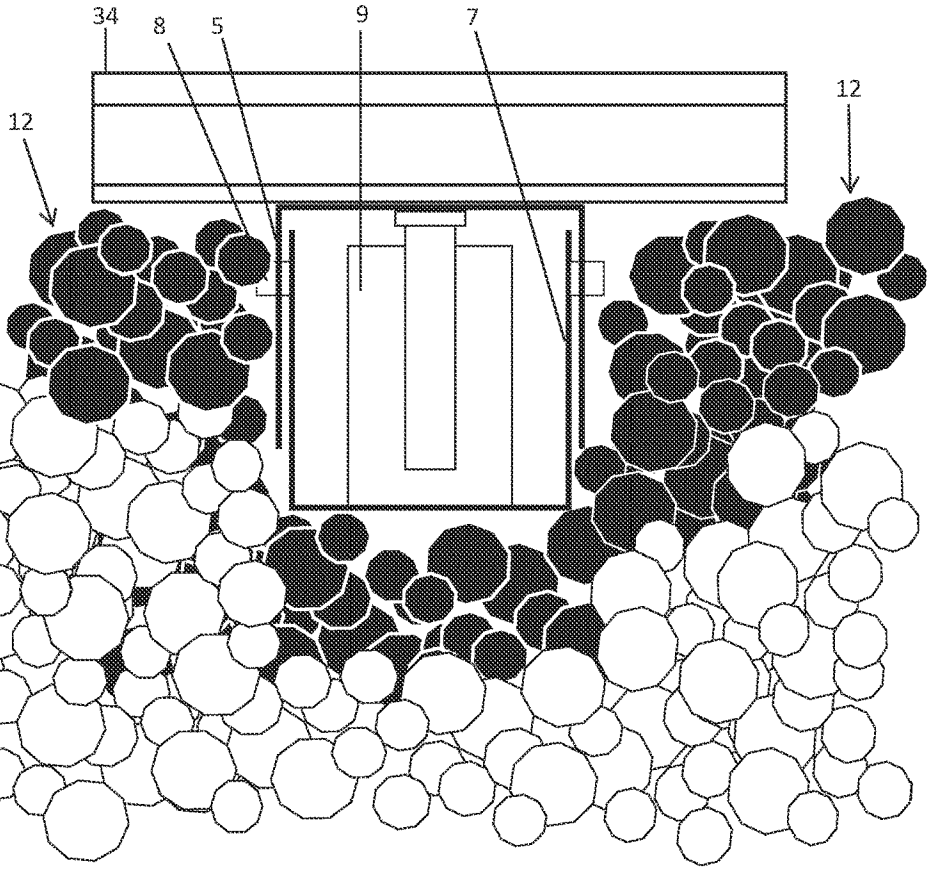
FIG. 18 illustrates the side view of FIG. 17 having ballast position in the openings of FIG. 17.
Figure 17:
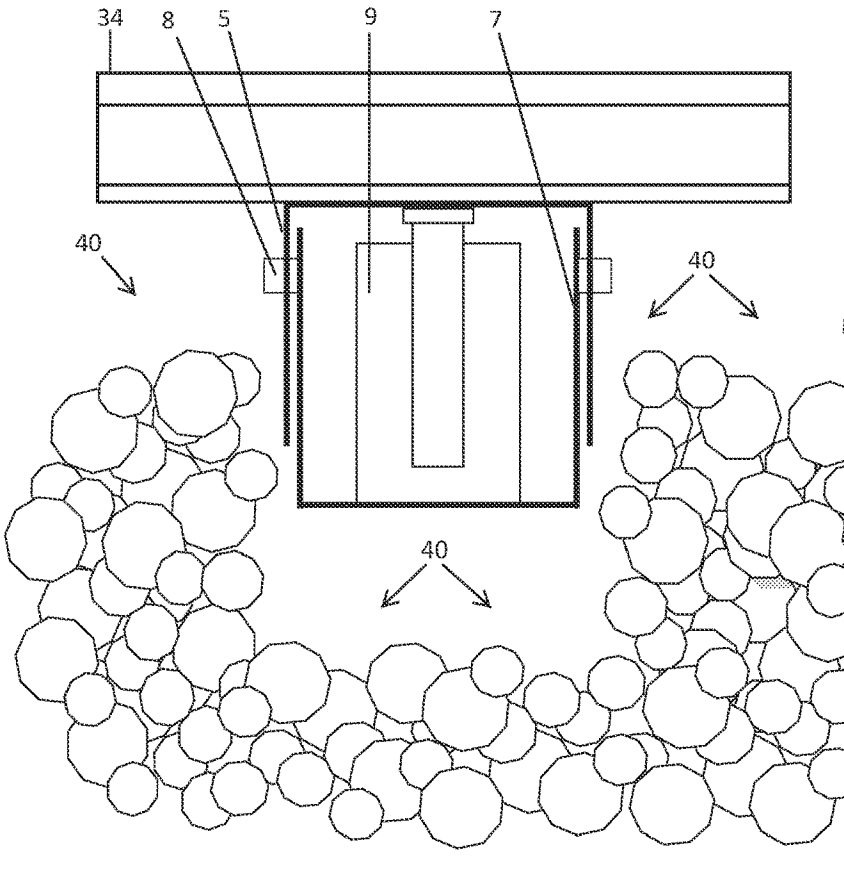
FIG. 17 illustrates the side view of FIG. 16.

FIGS. 17 and 18 illustrate a compressed hydraulic jack cylinder in the jacking tie subsequently having ballast positioned around the jacking tie. FIG. 17 illustrates a suspended jacking tie having voids 40 including a void below the jacking tie. FIG. 18 illustrates new ballast 1 positioned in and around the jacking tie. The jacking tie can then be removed, and the void filled with ballast or alternatively the jacking tie can be left in position for future utilization in lifting and or leveling the railroad track.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A jacking tie for raising and lowering adjacent rails of a railroad track, said jacking tie comprising:

an elongate body comprising a track support shell and a lower body shell, wherein said body comprises a length, wherein said length is configured to be positioned beneath the railroad track such that said body spans between the adjacent rails;

wherein said track support shell is pivotally attached to said lower body shell generally at a midpoint of said body by a pivoting connection;

a pair of jacks, wherein said pair of jacks comprise a first jack and a second jack positioned in said body on opposing sides of said pivoting connection, wherein said first jack is configured to lift a first end of said track support shell, wherein said second jack is configured to lift a second end of said track support shell, wherein said first jack and said second jack are configured to be independently operable such that said first jack and said second jack are configured to lift a first end of said track support shell and a second end of said track support shell away from said lower body shell in a scissoring movement by pivoting at said pivoting connection; and wherein said body comprises a slot configured to allow for vertical travel of said pivoting connection to raise and lower said track support shell.

2. The jacking tie of claim 1, wherein said first jack and said second jack comprise hydraulic cylinder jacks.

3. The jacking tie of claim 1, wherein said slot is configured in said track support shell.

4. The jacking tie of claim 1, wherein said lower body shell comprises a pair of baffles positioned in said lower body shell on opposite sides of said pivoting connection.

5. The jacking tie of claim 1, wherein said lower body shell comprises a pair of hinged access panels positioned at opposite ends of said body, wherein said hinged access panels are configured to provide access to an interior of said body.

6. The jacking tie of claim 2, wherein each of said hydraulic cylinder jacks is configured for fluid connection with a remote hydraulic pump.

7. The jacking tie of claim 1, wherein said lower body shell comprises a structural baffle.

8. The jacking tie of claim 1, wherein said pivoting connection comprises a through pin extending through said track support shell and said lower body shell.

9. The jacking tie of claim 1, wherein said jacking tie is configured to replace a standard railroad tie.

10. A method of lifting a section of a railroad track, said railroad track comprising a plurality of horizontal railroad ties supporting two parallel rails in a bed of a ballast, said two parallel rails being configured for travel thereon of railway vehicle, said method comprising the following steps:

a. removing a railroad tie of the railroad track to provide a rail track void beneath the two parallel rails;

b. placing a jacking tie in said rail track void, said jacking tie comprising:

an elongate body comprising a track support shell and a lower body shell, wherein said body comprises a length, wherein said length is configured to be positioned beneath the railroad track such that said body spans between two adjacent rails of the railroad track;

wherein said track support shell is pivotally attached to said lower body shell generally at a midpoint of said body by a pivoting connection, a pair of jacks, wherein said jacks comprise a first jack and a second jack positioned in said body on opposing sides of said pivoting connection, wherein said first jack is configured to lift a first end of said track support shell, wherein said second jack is configured to lift a second end of said track support shell, wherein said first jack and said second jack are configured to be independently operable such that said first jack and said second jack are configured to lift a first end of said track support shell and a second end of said track support shell away from said lower body shell in a scissoring movement by pivoting at said pivoting connection; and wherein said body comprises a slot configured to allow for vertical travel of said pivoting connection to raise and lower said track support shell;

wherein said jacking tie is positioned under said two parallel rails such that said parallel rails are supported by said jacking tie such that each jack is positioned beneath a rail;

c. selectively actuating said jacks to lift said section of said railroad track; and d. placing ballast into any air gaps formed by the step of lifting said section of railroad track.

11. The method of claim 10, further comprising removing said jacking tie and placing ballast into a jacking tie void formed by removing said jacking tie.

12. The method of claim 10, wherein said jacks comprise hydraulic jack cylinders.

13. The method of claim 12, further comprising providing a hydraulic pump configured for actuation of said hydraulic jack cylinders.

* * * * *